United States Patent [19]

Newberry et al.

[11] 4,414,035

[45] Nov. 8, 1983

[54] METHOD FOR THE REMOVAL OF ASPHALTENIC DEPOSITS

[75] Inventors: Michael E. Newberry, Chesterfield; Kenneth M. Barker, Crestwood, both of Mo.

[73] Assignee: Petrolite Corporation, St. Louis, Mo.

[21] Appl. No.: 40,628

[22] Filed: May 21, 1979

[51] Int. Cl.[3] ..... B08B 3/08

[52] U.S. Cl. ..... 134/3; 134/40

[58] Field of Search ..... 134/3, 40; 252/8.55 B, 252/143, 170, 171, 364

[56] References Cited

U.S. PATENT DOCUMENTS

| | | | |
|---|---|---|---|
| 2,356,254 | 8/1944 | Lehmann et al. | 252/8.55 D |
| 2,911,371 | 11/1959 | Weis | 134/40 X |
| 3,172,473 | 3/1965 | Crowley et al. | 252/8.55 B |
| 3,574,123 | 4/1971 | Laugle | 252/143 X |
| 3,718,586 | 2/1973 | Rollo et al. | 252/8.55 B |
| 3,953,338 | 4/1976 | Straus et al. | 252/8.55 B X |
| 4,070,203 | 1/1978 | Neisius et al. | 252/143 X |
| 4,165,294 | 8/1979 | Mey | 252/143 |
| 4,165,295 | 8/1979 | Mey | 252/143 |
| 4,169,068 | 9/1979 | Harita et al. | 252/143 |

*Primary Examiner*—Marc L. Caroff

*Attorney, Agent, or Firm*—Sidney B. Ring; Hyman F. Glass; Leon Zitver

[57] ABSTRACT

This invention relates to the removal of organic deposits containing asphaltenic compounds from surfaces with hydrocarbon-substituted arylsulfonic acids such as alkaryl sulfonic acids; a composition comprising a mixture of:

(1) an aromatic hydrocarbon, and (2) a hydrocarbon-substituted-alkarylsulfonic acid such as an alkaryl sulfonic acid, for example an alkylbenzenesulfonic acid where the alkyl group has at least 5 carbon atoms, for example, from about 5 to 20 carbon atoms can be used for the removal of organic deposits containing asphaltenic compounds from surfaces.

14 Claims, No Drawings

METHOD FOR THE REMOVAL OF ASPHALTENIC DEPOSITS

FIELD OF INVENTION

The present invention relates to the removal of organic deposits from surfaces, and more particularly, but not by way of limitation, to a method and solvent for removing organic deposits containing asphaltenic compounds from surfaces.

BACKGROUND OF THE INVENTION PRIOR ART

Organic deposits derived from crude oil have long been a source of trouble and operating expense to petroleum producers. These organic deposits may be almost totally paraffinic in nature or they may be highly asphaltic, depending on the particular crude oil produced. The deposits accumulate in tubular goods, production and storage equipment, and pipelines as well as on the faces of producing formations in oil and water wells. As the organic deposits build up in production equipment, tubular goods, and related apparatus, production is gradually decreased until remedial work is required to remove the deposits. Heretofore, removal of such organic deposits has been accomplished by mechanical scraping of the surfaces of equipment utilizing knives, scrapers, and similar devices, and also by dissolving the deposits in solvents such as hot crude oil and kerosene.

While solvents such as hot crude oil and kerosene are relatively effective for dissolving organic deposits which are paraffinic in nature, they are relatively ineffective for dissolving asphaltenic compounds. In general, organic deposits of high asphaltenic compound content are hard and brittle while deposits formed primarily of paraffinic compounds are soft and pliable. Thus, deposits containing asphaltenic compounds have heretofore been particularly troublesome to oil producers in that they are difficult to remove by mechanical methods and conventional solvents are relatively ineffective in their removal. Stripping asphaltenes from mineral surfaces is discussed in an article by Jeffries-Harris et al. entitled "Solvent Stimulation in Low Gravity Oil Reservoirs" which appears in the February 1969 issue of the *Journal of Petroleum Technology* at page 171. The author discloses the use of a standard well stimulation solvent, diesel oil, by itself and in combination with certain additives to dissolve asphaltenes. Some of the materials utilized by Jeffries-Harris include diesel oil; diesel oil-5% xylene; diesel oil-5% xylene-1%n-butyl amine; diesel oil-1% n-butylamine; diesel oil-5% toluene; and diesel oil-¼% hexylamine. The combination of diesel oil and 1% n-butylamine appeared to be substantially superior to diesel oil alone with respect to dissolving asphaltenes, but the combinations diesel oil-5% xylene-1% n-butylamine, diesel oil-5% xylene, and diesel oil-5% toluene appeared to provide very little, if any, improvement to the solvent power of diesel oil.

Gary Sutton's U.S. Pat. No. 3,914,132 issued Oct. 21, 1975 expanded upon this method of treatment by demonstrating the synergistic effects of amines and aromatic solvents on dissolving asphaltenic deposits. U.S. Pat. No. 3,914,132 discloses the invention consisting of a mixture of an aromatic solvent (benzene, toluene, xylene) and an amine selected from the group of pyridine, morpholine, and primary, secondary and tertiary amines defined by the general formula:

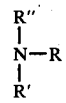

where R, R′, and R″ represent members selected from the group consisting of hydrogen, alkyl radicals having from 1 to 4 carbon atoms, cycloaklyl radicals having from 1 to 4 carbon atoms, cycloalkyl radicals having from 3 to 6 carbon atoms and mixtures thereof. He demonstrated the increased solubility of asphaltenic deposits in aromatic solvents with the inclusion of a relatively small amount of an amine (5% ethylenediamine).

The references cited in U.S. Pat. No. 3,914,132 are as follows:

United States Patents:

| | | | |
|---|---|---|---|
| 1,643,675 | 9/1927 | Montgomerie | 252/311.5 |
| 2,509,197 | 5/1950 | Borus et al | 252/153X |
| 2,685,523 | 8/1954 | Cross, Jr., et al. | 106/278X |
| 2,750,343 | 6/1956 | Beber | 252/153 |
| 2,904,458 | 9/1959 | Dykstra | 252/153X |
| 3,137,730 | 6/1964 | Fitz-William | 260/583P X |
| 3,279,541 | 10/1966 | Knox et al. | 252/8.55B X |
| 3,914,132 | 10/1975 | Sutton | 134/40 |

Other Publications:

Jeffries-Harris et al. "Solvent Stimulation in Low Gravity Oil Reservoirs" *Journal of Petroleum Technology*, February 1969; pp. 167–175.

We have now discovered that a composition comprising (1) an aromatic solvent, and (2) a hydrocarbon-substituted-alkarylsulfonic acid such as an alkylbenzene sulfonic acid can be used to effectively remove organic deposits containing asphaltic constituents.

Any effective hydrocarbon-substituted-alkarylsulfonic acid can be employed. In practice, an alkylbenzenesulfonic acid is employed where the alkyl group has at least about 5 carbon atoms, for example, from about 5 to 20 carbon atoms, such as from about 8 to 18 carbons, but preferably from about 10 to 14 carbon atoms. A polyalkyl-benzenesulfonic acid can be employed provided the total carbons in the alkyl groups have the above carbon value.

Any effective concentration of alkylbenzenesulfonic acid can be employed. The effective amount will depend on many variables, such as the particular sulfonic acid, the particular solvent, the particular system, etc. In practice, we employ about 1 to 80% by weight of the sulfonic acid in the solvent, e.g., from about 2 to 50, or from about 5 to 40, for example, from about 5 to 30, but preferably from about 10 to 25.

The preferred solvent comprises a liquid aromatic hydrocarbon, for example benzene, toluene, and xylene; or mixtures thereof.

In certain instances where the oil produced is rich in aromatic hydrocarbons, the alkarylsulfonic acid (100%) may be added to or dissolved in the produced oil. Mixtures of alkyl benzenesulfonic acids have also been employed.

DESCRIPTION OF THE PREFERRED EMBODIMENTS

The present invention is directed to a method and solvent for the dissolution of organic deposits containing asphaltenic constituents. Concerning the method for the removal of the organic deposits containing asphaltenic constitutents from various surfaces, the solvent can be applied in a number of ways. The solvent of this invention can be allowed to contact the deposit for a minimal amount of time as in the case of continuous injection into a moving fluid. This was the reason for the relatively short contact times used in the solubility tests. Another more effective technique would be direct contact of the deposit with non-diluted solvent and a lengthy contact period of from ½ to 24 hours. This can be accomplished either under static (soak) conditions or dynamic (circulate) conditions. The application can be done either hot or cold depending on the discretion of the user.

The composition employed herein comprises a mixture of:

(1) an aromatic hydrocarbon, and (2) a hydrocarbon-substituted-alkarylsulfonic acid such as an alkaryl sulfonic acid, for example, an alkyl benzenesulfonic acid where the alkyl group has at least 5 carbon atoms, for example, from about 5 to 20 carbon atoms. These compositions can be used for the removal of organic deposits from surfaces. These deposits consist primarily of asphaltenic constituents that are removed by dissolution of the deposits in the invention composition.

It has been found that the solvent of this invention, which is comprised of an aromatic hydrocarbon and an acid, in particular amounts of each, unexpectedly dissolves a greater quantity of organic deposits containing asphaltenic compounds in the same interval of time than would be predicted from either the acid or the aromatic hydrocarbon acting alone.

A preferred solvent of the present invention consists essentially of a liquid aromatic hydrocarbon and an acid of the type described above wherein the acid is present in the solvent in an amount described above.

Examples of aromatic hydrocarbons which are particularly useful in the present invention are benzene, toluene and xylene. Examples of acids which are particularly useful in the present invention are decyl benzenesulfonic acid, undecyl benzenesulfonic acid, dodecyl benzenesulfonic acid, tridecyl benzenesulfonic acid, tetradecyl benzenesulfonic acid, pentadecyl benzenesulfonic acid and hexadecyl benzenesulfonic acid.

A more specific preferred solvent of the present invention is comprised of an aromatic hydrocarbon selected from the group of toluene, xylene and benzene and an acid selected from the group of decyl benzenesulfonic acid, dodecyl benzenesulfonic acid, tridecyl benzene-sulfonic acid, and tetradecyl benzenesulfonic acid wherein the acid is present in the solvent in an amount of 5 to 30%.

Again a more specific solvent of the present invention would consist essentially of toluene and dodecyl benzenesulfonic acid wherein the acid is present in the solvent in an amount of about 25% by total weight of the solvent.

The following examples are provided to exhibit certain specific embodiments of the solvent and process of this invention. However, these embodiments are presented by way of example and not by way of limitation of the scope of this invention.

In the Examples which follow, the experimental procedures outlined below were followed.

A Bausch and Lomb Spectronic 88 apparatus was employed to make determinations of percent transmittance of various dilute solutions. The colorimeter was used to measure the quantity of light having a wave length of 635 nanometers passing through the solutions. The asphaltenic material used in these tests were cutting samples taken from a tubing string and analysis of the material showed the following composition:

| | |
|---|---|
| Oil | 7.8% |
| Asphaltenes | 74.1% |
| Asphaltic Resins | 13.3% |
| Paraffin | 0.4% |
| Basic Solids | 4.4% |

The asphaltenic material was separated according to size using a U.S. Standard Sieve Series set of screens. The material between 0.250 inch and 0.185 inch was used in order to operate with uniform sample size while maintaining a relatively small surface area when using a 0.5 g asphaltenic sample amount.

Several standard solutions were made by totally dissolving a weighed amount of the asphaltenic material in xylene. The solutions were further diluted 100 microliters in 10 ml reagent xylene and gave the following concentration versus % transmittance data.

TABLE 1

| SOLVENT Grams Asphaltic Material per gram xylene | % TRANSMITTANCE 635 Nanometers |
|---|---|
| $0.5 \times 10^{-8}$ | 97.9 |
| $1.5 \times 10^{-8}$ | 92.6 |
| $2.5 \times 10^{-8}$ | 86.9 |
| $3.5 \times 10^{-8}$ | 83.1 |
| $5.0 \times 10^{-8}$ | 75.2 |
| $6.5 \times 10^{-8}$ | 70.4 |
| $7.5 \times 10^{-8}$ | 66.0 |
| $10.0 \times 10^{-8}$ | 58.1 |
| $12.5 \times 10^{-8}$ | 52.2 |
| $15.0 \times 10^{-8}$ | 46.9 |
| $17.5 \times 10^{-8}$ | 41.0 |
| $20.0 \times 10^{-8}$ | 34.2 |
| $22.5 \times 10^{-8}$ | 32.5 |
| $25.0 \times 10^{-8}$ | 27.8 |

The colorimeter is checked both before and after each reading of % transmittance with reagent grade xylene to insure that the apparatus is zeroed to 100% transmittance for the reagent grade xylene alone. The data listed in Table 1 is then plotted on linear graph paper and the resulting curve is used to determine the weight of asphaltic material dissolved by each of the test solutions.

The dissolution tests of the solvent mixtures on the asphaltic materials were run under static conditions. A ½ gram amount of the 0.25 to 0.185 inch asphaltic materials was dropped into 20 g of the test solution and allowed to remain undisturbed for 5 minutes. The solution was then inverted 3 times slowly to produce a uniform solution and 100 microliters was extracted and diluted with 10 g reagent xylene. This final solution represents a $1 \times 10^{-5}$ dilution of the original 20 g solvent being tested.

Table 2 demonstrates the dissolution properties of various solvents and formulations of the present invention along with other materials for a comparison. The contact time and procedures were identical for all tests and followed the technique listed above.

TABLE 2

| Solvent, % by Weight | Transmittance % at 635 Nanometers | Grams Asphaltic Material Per Gram Solvent - 5 Minute Test |
|---|---|---|
| 100% Xylene | 94.0 | $1.4 \times 10^{-8}$ |
| 100% Benzene | 92.5 | $1.6 \times 10^{-8}$ |
| 100% Toluene | 87.0 | $2.8 \times 10^{-8}$ |
| 90% Xylene 10% Oleic Acid | 95.0 | $1.2 \times 10^{-8}$ |
| 90% Xylene 10% Phenol | 90.0 | $2.2 \times 10^{-8}$ |
| 90% Xylene 10% Benzoic Acid | 91.0 | $2.0 \times 10^{-8}$ |
| 90% Xylene 10% Pyridine | 84.0 | $3.4 \times 10^{-8}$ |
| 90% Xylene 10% Dodecyl Benzene Sulfonic Acid (commercial grade) | 77.8 | $4.6 \times 10^{-8}$ |
| 90% Xylene 10% Octanoic Acid | 93.1 | $1.7 \times 10^{-8}$ |

Table 3 below further develops the area of alkyl benzene-sulfonic acid/aromatic solvent effects on asphaltic deposits with a concentration study of dodecyl benzenesulfonic acid (commercial grade).

TABLE 3

| Solvent Weight % Xylene | % by Weight Dodecyl Benzenesulfonic acid (commercial grade) | Transmittance % at 635 Nanometers | Grams Asphaltic Material Per Gram Solvent - 5 Minute Test |
|---|---|---|---|
| 100 | 0 | 94.0 | $1.4 \times 10^{-8}$ |
| 95 | 5 | 78.2 | $4.6 \times 10^{-8}$ |
| 90 | 10 | 75.8 | $5.0 \times 10^{-8}$ |
| 85 | 15 | 75.8 | $5.0 \times 10^{-8}$ |
| 80 | 20 | 76.0 | $4.9 \times 10^{-8}$ |
| 75 | 25 | 75.9 | $4.95 \times 10^{-8}$ |
| 70 | 30 | 81.6 | $3.8 \times 10^{-8}$ |
| 65 | 35 | 82.9 | $3.6 \times 10^{-8}$ |
| 60 | 40 | 85.2 | $3.1 \times 10^{-8}$ |
| 55 | 45 | 84.0 | $3.4 \times 10^{-8}$ |
| 50 | 50 | 86.5 | $2.8 \times 10^{-8}$ |
| 40 | 60 | 88.0 | $2.6 \times 10^{-8}$ |
| 30 | 70 | 92.0 | $1.8 \times 10^{-8}$ |
| 20 | 80 | 97.0 | $0.8 \times 10^{-8}$ |
| 10 | 90 | 98.0 | $0.5 \times 10^{-8}$ |
| 0 | 100 | 99.0 | $0.2 \times 10^{-8}$ |

Table 4 still further shows the degree of alkyl benzenesulfonic acids synergistic effects on an aromatic solvent's ability to dissolve asphaltic deposits. These are laboratory prepared alkyl benzenesulfonic acids.

TABLE 4

| Solvent Weight % Xylene | % by Weight Acid Type | Transmittance % at 635 Nanometers | Grams Asphaltic Material Per Gram Solvent - 5 Minute Test |
|---|---|---|---|
| 100 | | 94.0 | $1.4 \times 10^{-8}$ |
| 90 | 10 Hexyl Benzenesulfonic acid | 77.2 | $4.8 \times 10^{-8}$ |
| 90 | 10 Octyl Benzenesulfonic acid | 78.0 | $4.6 \times 10^{-8}$ |
| 90 | 10 Decyl Benzenesulfonic acid | 74.2 | $5.4 \times 10^{-8}$ |
| 90 | 10 Dodecyl Benzenesulfonic acid | 70.2 | $6.4 \times 10^{-8}$ |
| 90 | 10 Tetradecyl Benzenesulfonic acid | 69.2 | $6.6 \times 10^{-8}$ |
| 90 | 10 Hexadecyl Benzenesulfonic acid | 76.5 | $4.8 \times 10^{-8}$ |

TABLE 4-continued

| Solvent Weight % Xylene | % by Weight Acid Type | Transmittance % at 635 Nanometers | Grams Asphaltic Material Per Gram Solvent - 5 Minute Test |
|---|---|---|---|
| 90 | 10 Octadecyl Benzenesulfonic acid | 78.0 | $4.6 \times 10^{-8}$ |

In order to compare the solvent of this invention with solvents of prior art, 9 solvents previously mentioned in the Sutton Patent U.S. Pat. No. 3,914,132 were prepared and tested against the commercial grade dodecyl benzenesulfonic acid. The data is shown in Table 5.

TABLE 5

| Prior Art Solvent % by Weight | | Transmittance % at 635 | Grams Asphaltic Material Per Gram Solvent - |
|---|---|---|---|
| Xylene | Amine | Nanometers | 5 Minute Test |
| 95 | 5 Morpholine | 92.7 | $1.6 \times 10^{-8}$ |
| 95 | 5 Triethanolamine | 95.5 | $1.0 \times 10^{-8}$ |
| 95 | 5 Monoethanolamine | 92.0 | $1.8 \times 10^{-8}$ |
| 95 | 5 Pyridine | 90.0 | $2.2 \times 10^{-8}$ |
| 95 | 5 Diethanolamine | 93.3 | $1.5 \times 10^{-8}$ |
| 95 | 5 Monoisopropanolamine | 92.4 | $1.7 \times 10^{-8}$ |
| 95 | 5 Di-isopropylamine | 90.0 | $2.2 \times 10^{-8}$ |
| 95 | 5 Ethylenediamine | 87.2 | $2.5 \times 10^{-8}$ |
| 95 | 5 N—butylamine | 86.2 | $3.0 \times 10^{-8}$ |
| 95 | 5 Dodecyl benzenesulfonic acid | 81.5 (commercial grade) | $3.8 \times 10^{-8}$ |

EXAMPLE 1

A solvent comprised of xylene and 10% commercial grade dodecyl benzenesulfonic acid by weight is prepared. The solubility of the asphaltic material previously described is determined via a colorimeter test of % transmittance at 635 nonometers and compared to that of the xylene solubility effects alone. The xylene—commercial grade dodecyl benzenesulfonic acid solvent dissolves the asphaltic deposits 3.3 times as well in 5 minutes as the xylene alone.

EXAMPLE 2

A solvent comprised of xylene and 5% commercial grade dodecyl benzenesulfonic acid by weight is prepared. The solubility of asphaltic material previously described is determined and compared to that of the xylene solvent alone. The xylene-commercial grade dodecyl benzenesulfonic acid solvent dissolves the deposits 2.24 times as well in 24 hours as the xylene alone.

EXAMPLE 3

A solvent comprised of xylene and commercial grade dodecyl benzenesulfonic acid wherein the acid is present in the amount of 10% by weight is prepared. The solubility of asphaltic material in the solvent is determined and compared with the solubility of the deposits in a prior art mixture of 90% xylene and 10% pyridine determined by weight. It is found that the xylene-commercial grade dodecyl benzenesulfonic acid dissolved 35.3% more deposits than the xylene-pyridine mixture in 5 minutes.

EXAMPLE 4

A solvent comprised of xylene and laboratory prepared dodecyl benzenesulfonic acid is prepared wherein the dodecyl benzenesulfonic acid is present in the amount of 10% by weight. The solubility of the asphaltic deposits in the solvent is determined and compared to that of the xylene alone. It is determined that the xylene-dodecyl benzenesulfonic acid dissolves the deposits 4.6 times as well as the xylene alone in 5 minutes.

EXAMPLE 5

A solvent comprised of toluene and commercial grade dodecyl benzenesulfonic acid wherein the commercial grade dodecyl benzenesulfonic acid is present in the amount of 25% by weight is prepared. The solubility of the asphaltic deposits in the solvent is determined and compared to the toluene alone. It is determined that the toluene-commercial grade dodecyl benzenesulfonic acid solvent dissolves 2.5 times as well as the toluene alone in 5 minutes.

From the above tables and examples, it may be observed that a considerable improvement in the solvent dissolution rate of the asphaltic deposits is obtainable through the use of the solvent mixtures of the present invention. A synergistic effect resulting in greater dissolution rates of asphaltic materials is evidenced in Table 3 through the use of the solvent mixtures of the present invention rather than the aromatic solvent or alkyl benzenesulfonic acid alone.

Although the present invention has been described with references to certain specific preferred embodiments for illustrative and explanatory purposes, the invention is not limited thereto, but includes within the scope of the invention such modifications and variations as comes within the scope and spirit of the claims.

What we claim is:

1. A process for removing organic deposits containing asphaltenic constituents from surfaces which comprises contacting said organic deposits with a solvent mixture containing (1) an aromatic solvent, and (2) a hydrocarbon-substituted-alkarylsulfonic acid.

2. The process of claim 1 where the hydrocarbon-substituted-alkarylsulfonic acid is an alkylbenzene sulfonic acid.

3. The process of claim 2 where the sum of the carbons on the alkyl group(s) of said acid is at least 5 carbons.

4. The process of claim 3 where the sum of the carbons on the alkyl group(s) of said acid is from about 5 to 20 carbons.

5. The process of claim 4 where the alkylbenzenesulfonic acid is selected from the group consisting of hexyl benzenesulfonic acid, octyl benzenesulfonic acid, decyl benzenesulfonic acid, undecyl benzenesulfonic acid, dodecyl benzenesulfonic acid, tridecyl benzenesulfonic acid, tetradecyl benzenesulfonic acid, pentadecyl benzenesulfonic acid, hexadecyl benzenesulfonic acid and octadecyl benzenesulfonic acid.

6. The process of claim 5 where the alkylbenzenesulfonic acid present in the solvent is from about 2 to 50% by weight.

7. The process of claim 6 where the alkylbenzenesulfonic acid present in the solvent is about 25% by weight.

8. A process for removing organic deposits containing asphaltenic constituents from surfaces which comprises contacting said organic deposits with a hydrocarbon-substituted-alkarylsulfonic acid dissolved in petroleum oil rich in aromatic hydrocarbons.

9. The process of claim 8 where the alkylsulfonic acid is alkylbenzenesulfonic acid.

10. The process of claim 9 where the sum of the carbons on the alkyl group(s) of said acid has at least 5 carbons.

11. The process of claim 10 where the alkyl group(s) of said acid has from about 5 to 20 carbons.

12. The process of claim 11 where the alkylbenzenesulfonic acid is selected from the group consisting of hexyl benzenesulfonic acid, octyl benzenesulfonic acid, decylbenzenesulfonic acid, undecyl benzenesulfonic acid, dodecyl benzenesulfonic acid, tridecyl benzenesulfonic acid, tetradecyl benzenesulfonic acid, pentadecyl benzenesulfonic acid, hexadecyl benzenesulfonic acid, and octadecyl benzenesulfonic acid.

13. The process of claim 7 where the alkylbenzenesulfonic acid is dodecyl benzenesulfonic acid and the aromatic solvent is benzene, xylene, toluene or mixtures thereof.

14. The process of claim 11 where the alkylbenzenesulfonic acid is dodecyl benzenesulfonic acid.

* * * * *